US006845845B2

(12) United States Patent
Schmid, Jr.

(10) Patent No.: US 6,845,845 B2
(45) Date of Patent: Jan. 25, 2005

(54) WATER RECREATION DOCK

(75) Inventor: Jerome R. Schmid, Jr., Seneca, SC (US)

(73) Assignee: JSV Group Inc.

( * ) Notice: Subject to any disclaimer, the term of this patent is extended or adjusted under 35 U.S.C. 154(b) by 0 days.

(21) Appl. No.: 10/392,135

(22) Filed: Mar. 19, 2003

(65) Prior Publication Data

US 2003/0178252 A1 Sep. 25, 2003

Related U.S. Application Data

(63) Continuation-in-part of application No. 10/097,661, filed on Mar. 13, 2002, now Pat. No. 6,793,039.

(51) Int. Cl.[7] ..... E04G 3/10; E04G 3/00; B63C 1/00

(52) U.S. Cl. ..... 182/84; 182/141; 182/150; 405/218; 405/221

(58) Field of Search ..... 182/84, 97, 150, 182/93, 141; 114/362; 405/196, 201, 202, 218, 221, 220

(56) References Cited

U.S. PATENT DOCUMENTS

| | | | | |
|---|---|---|---|---|
| 1,419,834 A | | 6/1922 | Fellows | |
| 3,088,123 A | | 5/1963 | Loughridge | 4/172 |
| 3,559,762 A | | 2/1971 | Thompson | 182/93 |
| 3,592,468 A | | 7/1971 | Simendinger, Jr. | 273/1 |
| 3,731,761 A | | 5/1973 | Glenn | 182/1 |
| 3,813,703 A | | 6/1974 | Beaudin, Jr. | 4/172 |
| 3,949,693 A | | 4/1976 | Bauer et al. | 114/0.5 D |
| 4,079,815 A | | 3/1978 | Cormier | 182/195 |
| 4,107,932 A | | 8/1978 | Cantrell | 61/48 |
| 4,271,542 A | | 6/1981 | Wood et al. | 4/495 |
| 4,900,187 A | | 2/1990 | Uchida et al. | 405/3 |
| 4,907,674 A | | 3/1990 | Miller | 182/150 |
| 4,910,814 A | | 3/1990 | Weiner | 4/488 |
| 4,971,168 A | * | 11/1990 | Stanescu | 182/1 |
| 5,025,747 A | | 6/1991 | Grayson | 114/362 |
| 5,044,465 A | | 9/1991 | Rinke | 182/97 |
| 5,056,167 A | | 10/1991 | Cholley | 4/492 |
| 5,507,596 A | | 4/1996 | Bostelman et al. | 405/191 |
| 5,626,440 A | | 5/1997 | Greene, Jr. et al. | 405/218 |
| 5,794,292 A | * | 8/1998 | Ricci, Jr. | 182/1 |
| 6,170,093 B1 | | 1/2001 | Kowalski | 4/496 |
| 6,237,523 B1 | | 5/2001 | Day et al. | 114/362 |
| 6,401,861 B1 | * | 6/2002 | Marszalek | 182/84 |

* cited by examiner

*Primary Examiner*—Hugh B. Thompson, II
(74) *Attorney, Agent, or Firm*—McNair Law Firm, P.A.

(57) ABSTRACT

A water recreation dock for providing access into and out of the water comprising a main deck platform carried by a dock frame. A stationary platform forms a first part of the main deck platform which is supported above the water on the dock frame. A movable platform forms a second part of the main deck platform which has a raised position and a lowered position. A landing section and a walkway section are included in the movable platform. In the raised position, the landing section and walkway section are located generally in a common horizontal plane with the stationary platform above the water. In the lowered position, the landing section is submerged and the walkway section is partially submerged as extending from the stationary platform to the landing section to provide access into and out of the water.

18 Claims, 6 Drawing Sheets

WATER RECREATION DOCK

CROSS REFERENCE TO RELATED APPLICATION

This Continuation-in-Part application claims the benefit of priority from U.S. non-provisional application Ser. No. 10/097,661, filed Mar. 13, 2002, now U.S. Pat. No. 6,793,039.

FIELD OF THE INVENTION

The present invention relates to a submergible water activity platform for use with a dock and the like to provide a platform for getting into and out of the surrounding water. More particularly, the present invention relates to a movable platform integrated into the dock so that the platform can move between a raised position level with the dock, and a lowered partially submerged position to provide access into an out of the water.

BACKGROUND OF THE INVENTION

Swimming facilities, whether in pools, rivers, ponds, lakes, and oceans, often provide ladders for people to enter and exit deep water. These ladders may be attached to the end of docks, piers, or even free-floating platforms anchored in the middle of a lake. These ladders are usually slippery and require a person to exert substantial strength to pull their body out of the water and onto the ladder. Persons who have trouble using ladders, including the handicapped, elderly, and even small children are effectively banned from participating in recreational water activities associated with deep-water facilities. The ladder also fails to provide any underwater support on which a person can rest or participate in deep water recreational activities. People, as well as their pets, enjoy jumping and swimming from docks, but often are in danger of drowning when they cannot climb back on the dock or find a place to rest, and are too tired to swim a long distance to shore.

Therefore, a need exists for a device that can facilitate the entry and exit of people and animals from a body of water to an above water structure by allowing the person and animals to swim directly onto a submerged platform and walk up out of the water by way of steps or a ramp. A need also exists to provide a device that gives underwater support to persons engaged in the recreational water activities in deep water on which the person can stand to participate in the water activities.

On many waterways, there are specific rules and regulations relating to the attachment of items that permanently extend off of a dock, some of which entirely prohibit underwater platforms that extend out from the dock. Therefore, there is a further need for a submergible activity platform that is integrated into the dock so as not to extend away from the dock to pose an unnecessary hazard to watercraft, and for a submergible platform that can be withdrawn from the water when not in use.

As shown in U.S. Pat. No. 3,559,762, a safety ladder is secured to a pylon of a dock, pier or other floating structure on a body of water that can be used to move between the water and the above water structure. However, the ladder fails to provide any support that extends under the water to provide a stable support platform on which persons may engage in recreational water activities. Additionally, such a ladder is extremely difficult for handicapped or disabled persons to use in entering or exiting from deeper water.

U.S. Pat. No. 5,044,465 discloses a retractable walk-in swimming pool ladder designed specifically for use with swimming pools. As with the above-noted patent, the retractable ladder fails to provide any support means extending under the water for persons to engaged in recreational water activities, but rather, simply provides an access between the pool deck and the water. The individual must still pull his body up out of the water to climb up the steps of the ladder.

U.S. Pat. No. 3,088,123 discloses a hydraulically operated pool lift ladder which has a single narrow step that is lowered and raised to help a person enter and exit the water. Because of the narrow step, there is no space for allowing a person to engage in water activities while being supported by the lift step.

U.S. Pat. No. 3,088,123 discloses a retractable platform for swimming pools. The device extends substantially away from the pool deck and does not disclose any means for integrating the submergible platform into the deck so as to form a usable part of the deck when removed from the water.

Thus, there is a need for a submergible support platform integrated into the dock that may be lowered to provide access the water and raised to form a part of the dock above the water.

Accordingly, it is an object of the present invention to provide a water recreation dock with a movable platform that moves between a lowered position that provides convenient access into and out of the water, and a raised position forming a part of the dock above the water to permit use of the movable platform for other activities then entering and exiting from the water.

It is an object of the present invention to provide a submergible activity platform that allows persons to swim directly onto and off of the platform for support in the water while engaged in recreational water activities.

It is an object of the present invention to provide a submergible activity platform integrated into the dock so that the platform does not extend out from the dock when submerged.

SUMMARY OF THE INVENTION

The above objectives are accomplished according to the present invention by providing a water recreation dock extending at least partially over a body of water for access into and out of the water. The dock comprises a main deck platform carried by an upper dock frame of the dock for accommodating a number of persons engaged in recreational activities. A stationary platform forms a first part of the main deck platform carried on the upper dock frame. A movable platform forms a second part of the main deck platform having a raised position and a lowered position. The movable platform includes a landing section and a walkway section for providing access into and out of the water from the stationary platform. The movable platform is located generally in a common horizontal plane with the stationary platform in the raised position so that the landing section and walkway section are positioned above the water with said stationary platform to provide the main deck platform. The movable platform is then at least partially submerged in the water below the stationary platform in the lowered position wherein the landing section is submerged and the walkway section is partially submerged as extending from the stationary platform to the landing section to provide access into and out of the water.

A drive assembly is carried at least in part by the stationary platform. The drive assembly is operatively connected with the movable platform for raising and lowering the movable platform. The drive assembly includes a vertical displacement mechanism extending downward beneath the stationary platform, and a drive motor carried by the stationary platform above the water. The vertical displacement mechanism carries the movable platform, and the drive motor is operatively connected with the vertical displacement mechanism. The drive motor and the vertical displacement mechanism cooperate to move the platform between the raised and lowered positions.

In a further advantageous embodiment, the walkway includes a set of collapsible steps. The collapsible steps have a collapsed condition when the movable platform is in the raised position wherein each of the steps is folded into lateral alignment in a common horizontal plane with the stationary platform, and the collapsible steps have an expanded condition when the movable platform is in the lowered position wherein each of the steps is staggered in an inclined arrangement to provide steps leading from the stationary platform to the landing section. A step frame is included for carrying the collapsible steps and has a first end pivotally connected to the stationary platform, and a second end pivotally connected to the landing section for moving with the landing section between the raised and lowered positions to collapse and expand the steps.

Preferably, a lock is included which is operatively associated with the stationary platform and the movable platform for locking the movable platform to the stationary platform in the raised position. The lock includes a first locking part carried by the stationary platform, and a second locking part carried by the movable platform. The first locking part engages the second locking part when the movable platform is in the raised position to interlock the stationary platform with the movable platform.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 1:
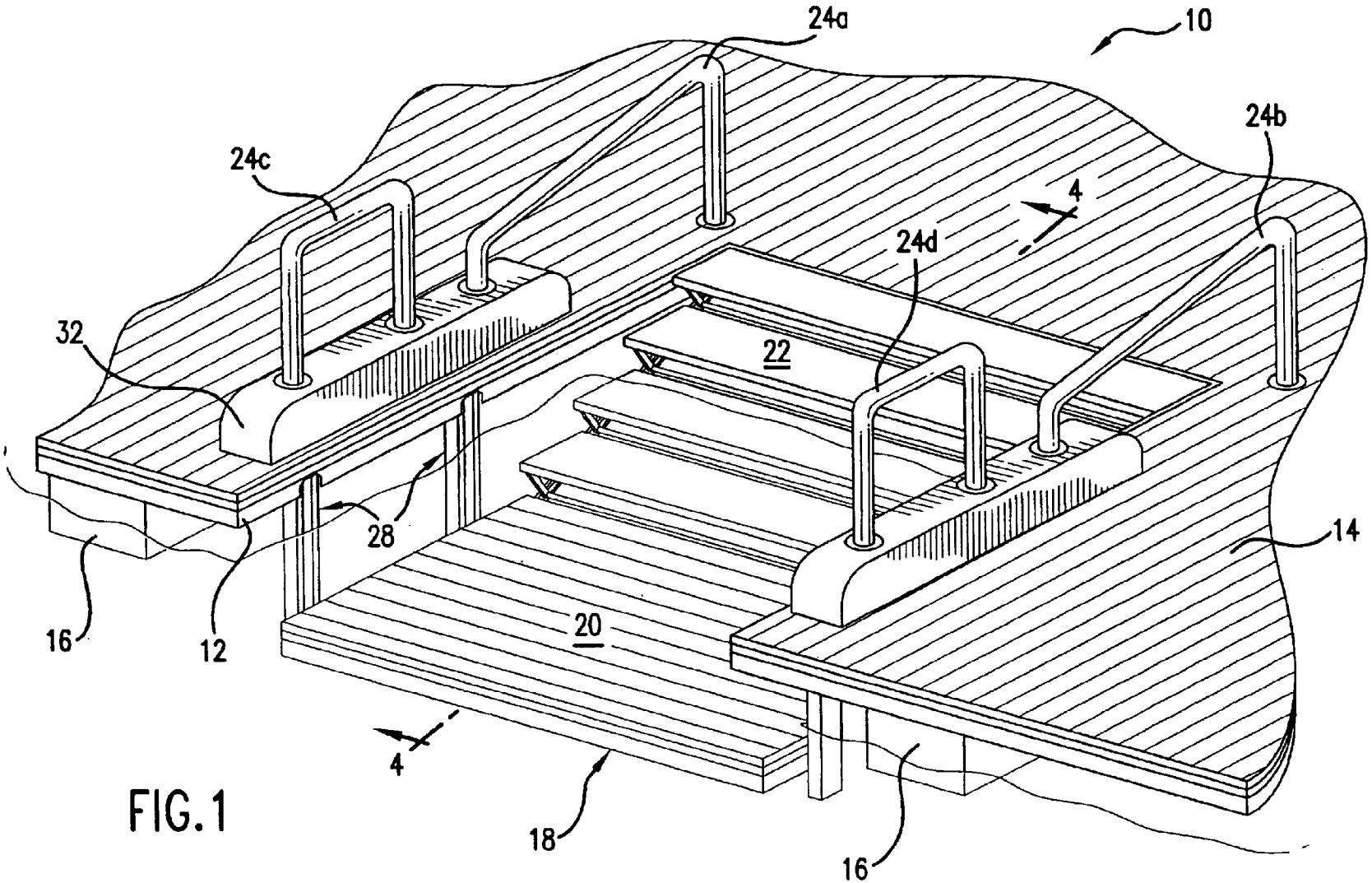
FIG. 1 shows a perspective view the water recreation dock in a lowered position according to the invention.
Figure 2:
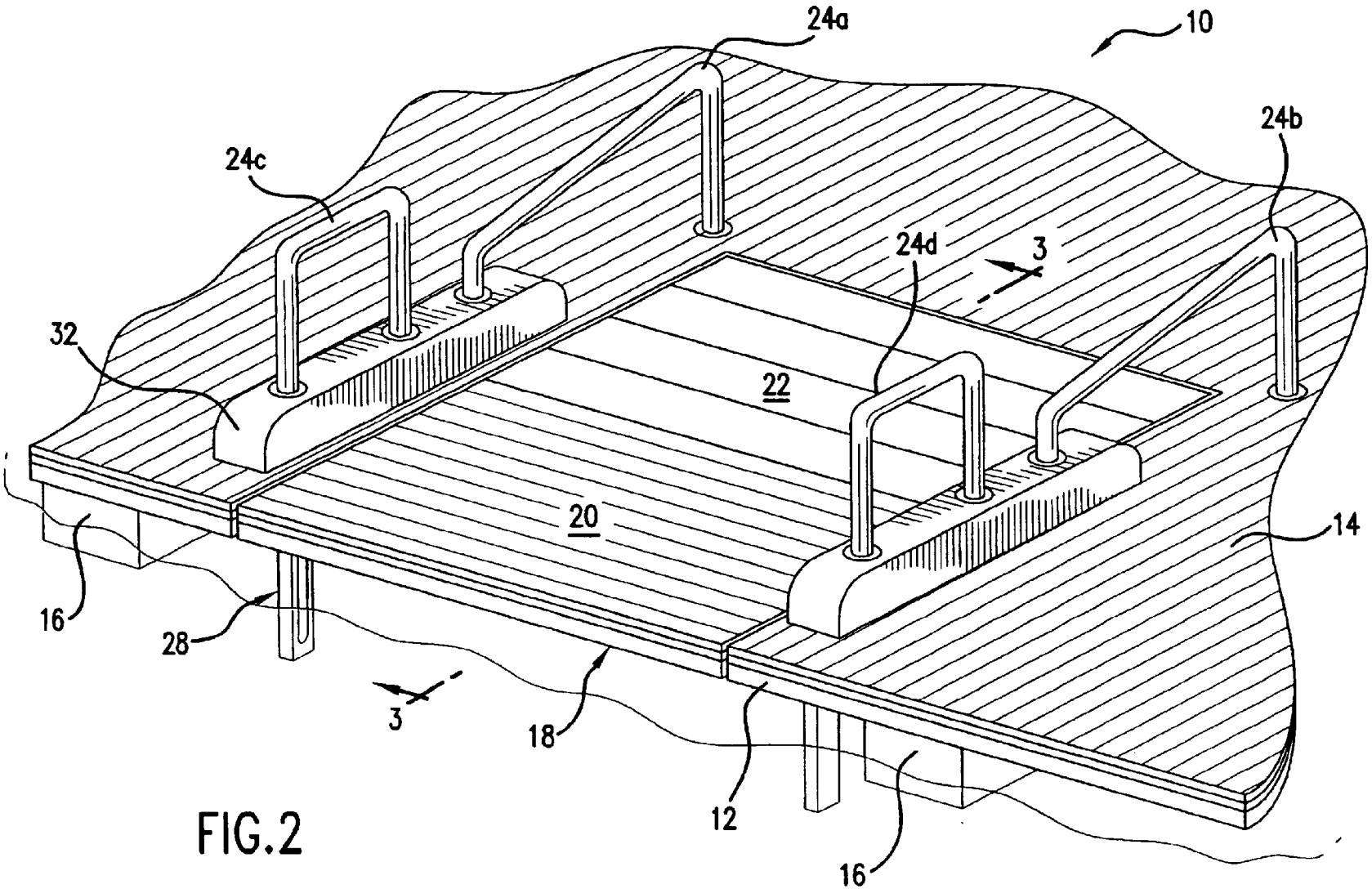
FIG. 2 shows a perspective view of the water recreation dock in a raised position according to the invention.

With reference to the drawings, the invention will now be described in more detail. Referring to FIGS. 1 and 2, a water recreation dock is shown extending at least partially over a body of water for providing access into and out of the water. The dock comprises a main deck platform, designated generally as 10, carried by an upper dock frame 12 which is generally supported above the water. The main deck platform is adapted for accommodating a number of persons engaged in recreational activities.

The main deck platform is divided into two parts, which together form main deck platform 10. A stationary platform 14 forms the first part of the main deck platform. As shown in the illustrated embodiment, stationary platform 14 is supported above the water on upper dock frame 12 by floating members 16. The floating members allow the stationary platform to adjust to changes in water level to ensure stationary platform 14 does not become too far removed from the surface of the water. However, various alternative means for supporting a platform on a body of water are commonly known to those skilled in the art and considered within the spirit and scope of this invention.

A movable platform, designated generally as 18, forms the second part of the main deck platform. Movable platform 18 is integrated into stationary platform 14 so that the movable platform does not extend out from the dock and create an obstruction to boats and other water craft operating next to the dock. Movable platform 18 is capable of moving between a raised position, shown in FIG. 2, and a lowered position, shown in FIG. 1.

The movable platform includes a landing section, designated generally as 20, and a walkway section, designated generally as 22, for providing access into and out of the water from stationary platform 14. Advantageously, as shown in FIG. 2, movable platform 18 can be raised to lie generally in a common horizontal plane with stationary platform 14 so that the landing section and walkway section are positioned above the water with said stationary platform to provide a main deck platform that is entirely removed from the water. In the raised position, stationary platform 14 and movable platform 18 form a uniformly level main deck platform. The raised position also provides the benefits of easy cleaning to remove algae, barnacles and other debris that collect on the movable platform when in the lowered position. In the lowered position shown in FIG. 1, movable platform 18 is at least partially submerged in the water below stationary platform 14 so that landing section 20 is submerged and walkway section 22 is partially submerged as extending from stationary platform 14 to landing section 20 to provide access into and out of the water. In the illustrated embodiment, landing section 20 creates a water activity area free of walkway 22 for supporting persons engaged in water activities. Thus, when the landing section is submerged, people can stand, sit, or swim off of or directly onto the submerged water activity area of the landing section for support in the water. This effectively creates a shallow water area for people to enjoy water recreation activities around deep-water facilities without the problems associated with typical ladders that are used to enter and exit from the water.

Preferably, stationary platform 14 and movable platform 18 are composed of a series of elongated planks made from treated lumber, composite materials, or other known components resistant to the corrosive effective of water and other elements commonly used to build docks. Additionally, to help people when entering and exiting from the water when movable platform 18 is in the lowered position, handrails 24*a-d* are provided for support.

Figure 3:
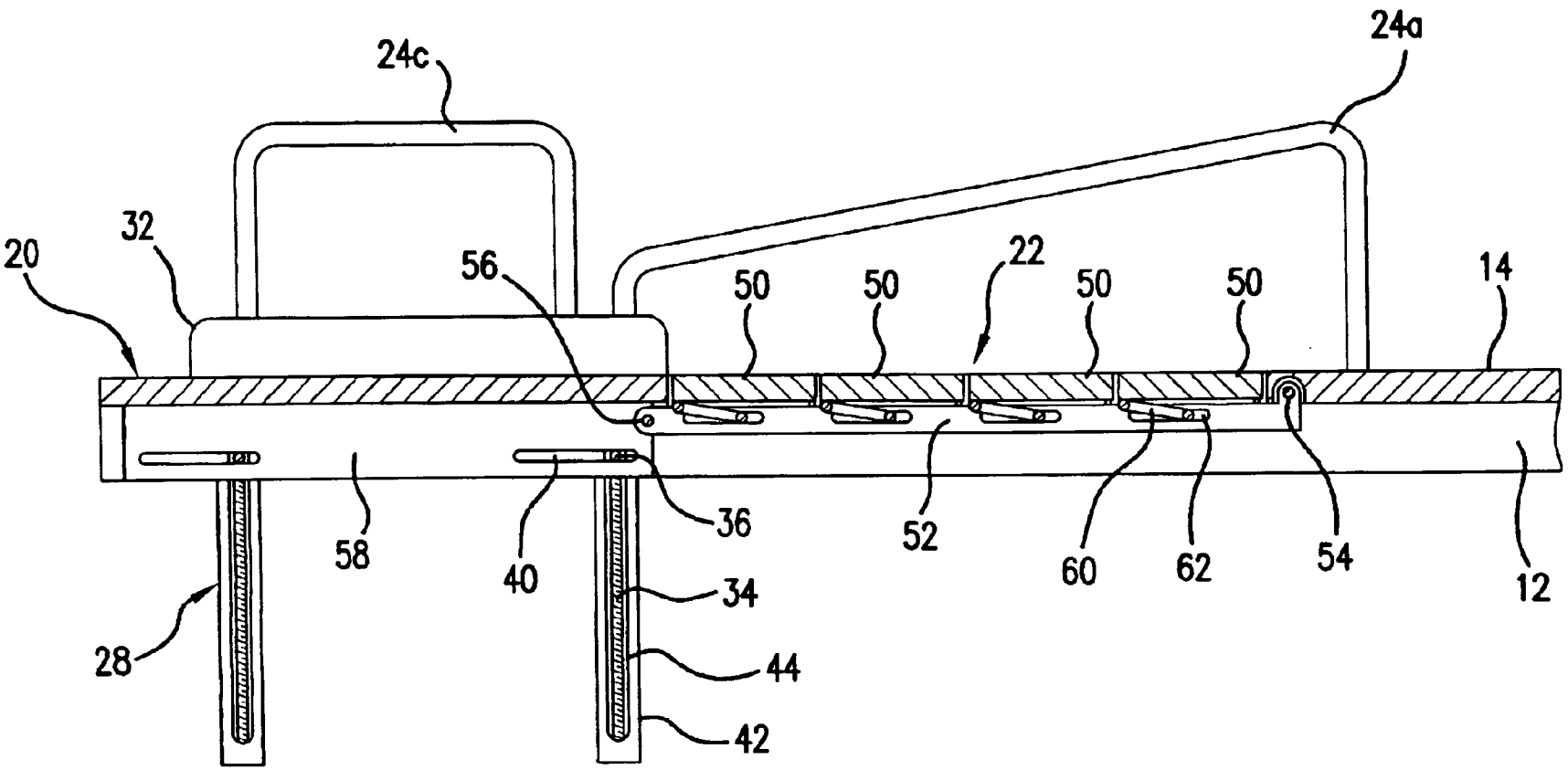
FIG. 3 shows a side elevation view of the water recreation dock in a raised position according to the invention.
Figure 4:
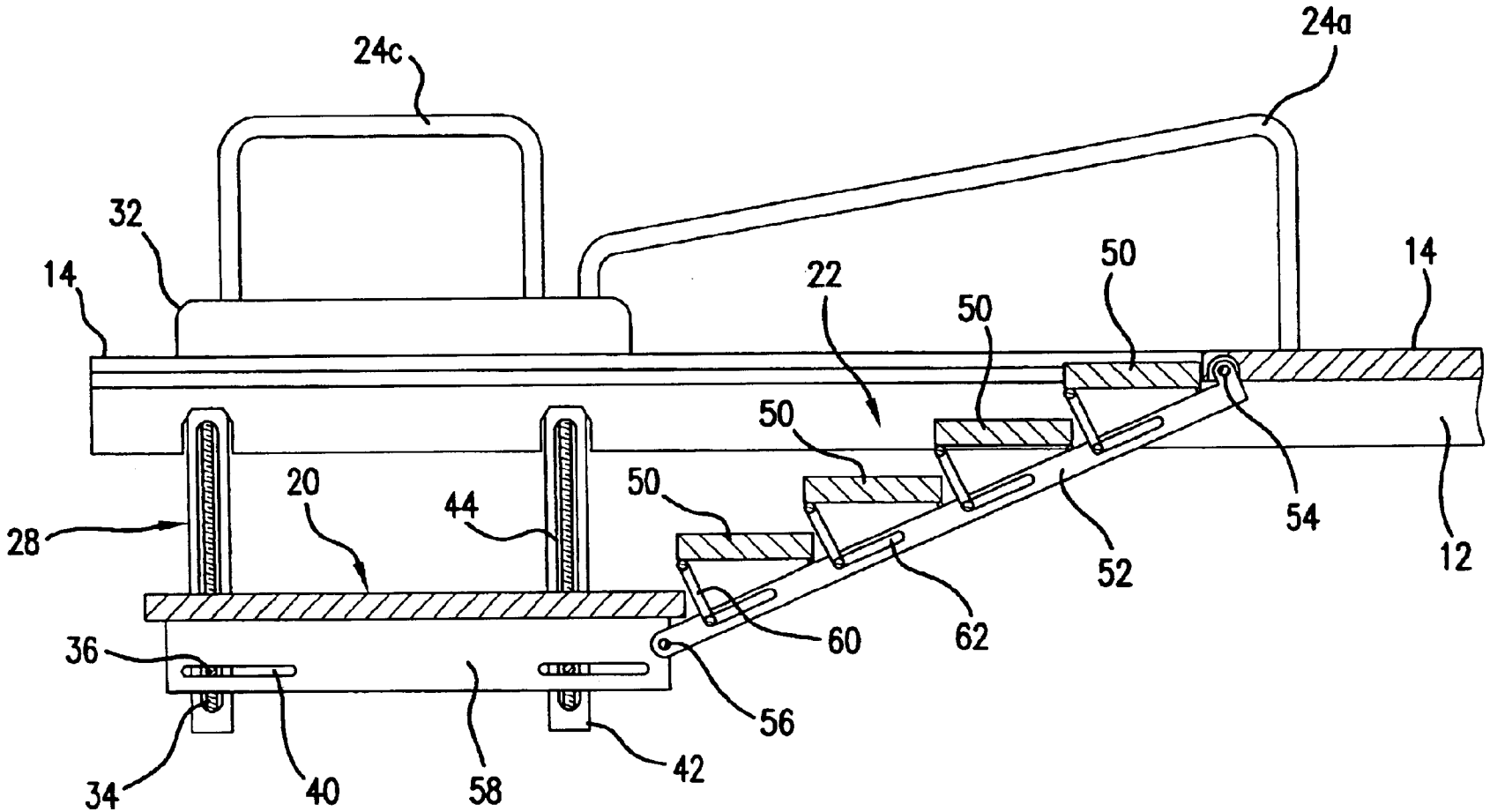
FIG. 4 shows a side elevation view of the water recreation dock in a lowered position according to the invention.
Figure 5:
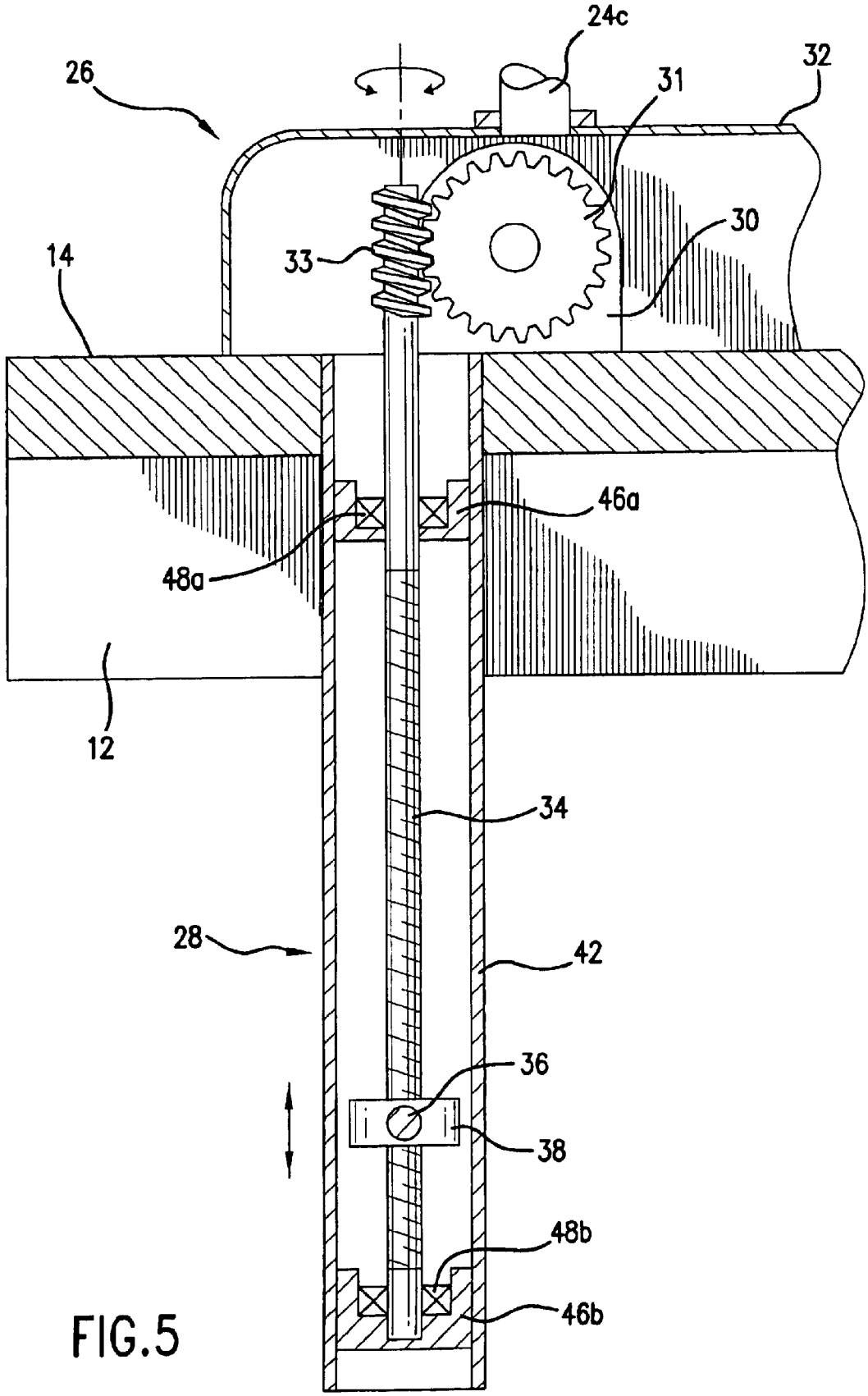
FIG. 5 shows a detailed cross-section view of the drive assembly according to the invention.

Referring to FIG. 5, a drive assembly, designated generally as 26, is operatively connected with movable platform 18. The drive assembly can be formed using any number of commonly known mechanisms to those persons skilled in the art, such as hydraulic, pneumatic and electromechanical operators adapted for raising and lowering the movable platform as described herein. In the preferred embodiment, drive assembly 26 is carried by stationary platform 14 and upper dock frame 12 for raising and lowering the movable platform to the desired position. Referring to FIGS. 3-5, the drive assembly includes a vertical displacement mechanism, designated generally as 28, extending downward beneath the stationary platform. The drive assembly also includes a drive motor 30, preferably carried by stationary platform 14 above the water. Drive motor 30 is protected by drive assembly cover 32 to prevent accidental damage to the assembly, or personal injury from accidental contact with moving parts. Vertical displacement mechanism 28 carries landing section 20 of movable platform 18, and drive motor 30 is operatively connected with vertical displacement mechanism 28. The drive motor and the vertical displacement mechanism cooperate to move the platform between the raised and lowered positions. Preferably, the vertical displacement mechanism allows the landing section to move at least two feet downward from the raised position to the lowered position. However, the invention is not limited to this distance and the drive assembly can be constructed and arranged to allow the movable platform to travel less than or considerably beyond two feet.

Referring to FIGS. 3 and 4, vertical displacement mechanism 28 includes an elongated shaft 34 extending vertically beneath stationary platform 14. Vertical displacement mechanism 28 also includes a lateral support arm 36 carried by elongated shaft 34 extending perpendicular to shaft 34, which carries landing section 20. Referring to FIG. 5, lateral support arm 36 travels along elongated shaft 34 when drive motor 30 is operated to raise and lower said landing section. Lateral support arm 36 has a first portion carrying a threaded collar 38 for cooperating with threads included on elongated shaft 34 to raise and lower lateral support arm 36. The second portion of lateral support arm 36 engages landing section 20 in horizontal slot 40, which allows landing section 20 to shift horizontally as described further below. Drive motor 30 includes drive gear 31 that engages worm gear 33 of elongated shaft 34 to rotate the shaft. When the shaft is rotated, threaded collar 38 is caused to travel along the threads of elongated shaft 34 so that lateral support arm 36 raises and lowers landing section 20.

A guide member 42 is carried by said upper dock frame 12 and stationary platform 14 which houses elongated shaft 34. Guide member 42 has an arm slot 44 extending along the length of guide member 42 for allowing lateral support arm 36 to be moved vertically along elongated shaft 34 while extending through arm slot 44. Landing section 20 abuts guide member 42 to restrict lateral movement of movable platform 18. This helps prevent the movable platform from shifting side to side when water or persons apply lateral forces to the assembly. Referring to FIG. 5, guide member 42 includes bushings 46*a* and 46*b*, which maintain elongated shaft 34 in proper vertical alignment and prevent bending of the shaft. Within bushings 46*a* and 46*b* are thrust bearings 48*a* and 48*b* that allow elongated shaft 34 to rotate smoothly within the brackets and prevent damage to the shaft.

Referring to FIGS. 3 and 4, walkway 22 comprises a set of collapsible steps, which can function as a set of steps leading from stationary platform 14 to landing section 20, or as a ramp when the movable platform is in the lowered position. The collapsible steps have a collapsed condition when the movable platform is in the raised position, best shown in FIG. 3, wherein each of steps 50 is folded into lateral alignment in a common horizontal plane with stationary platform 14. The collapsible steps also then have an expanded condition when the movable platform is in the lowered position, best shown in FIG. 4, wherein each of steps 50 is opened and staggered in an inclined arrangement to provide a set of steps leading from stationary platform 14 to landing section 20.

A step frame 52 disposed beneath steps 50 for carrying the collapsible steps. Step frame 52 has a first end 54 pivotally connected to the stationary platform, and a second end 56 pivotally connected to landing section 20. By pivotally attaching step frame 52 at both ends, the step frame moves with landing section 20 between the raised and lowered positions to collapse and expand the steps. Each of steps 50 carries a support leg 60 that is adapted to slidably engage leg slots 62 of step frame 52. As shown in FIG. 3, support leg 60 is disposed in a generally horizontal orientation underneath step 50 in a retracted position, which allows the step to lay flat on step frame 52 in the collapsed condition of FIG. 3. As movable platform 18 is lowered, support leg 60 slides along step frame 52 in leg slot 62 to a support position that is a generally vertical orientation holding step 50 in the expanded condition of FIG. 4. In order to expand and collapse the steps, one of several commonly know means may be used. For example, each of support legs 60 could be interconnected with a spring tensioning means connecting the interconnected support legs to upper dock frame 12 and landing frame 58.

Because step frame 52 does not telescope or otherwise adjust its length when being raised and lowered, it is necessary for landing section 20 to shift horizontally to accommodate the change in angle of step frame 52. As shown in FIGS. 3 and 4, landing section 20 includes a landing frame 58, which includes arm slots 40 discussed above, which allow landing frame 58 to slide on lateral support arms 36. As the movable platform is moved from the raised to lowered position, step frame 52 pulls landing section 20 inwards to accommodate the change in angle and distance. When raising landing section 20, step frame 52 pushes landing section 20 forward on lateral support arms 36 so that both walkway 22 and landing section 20 can align in a horizontal plane with stationary platform 14.

Figure 6:
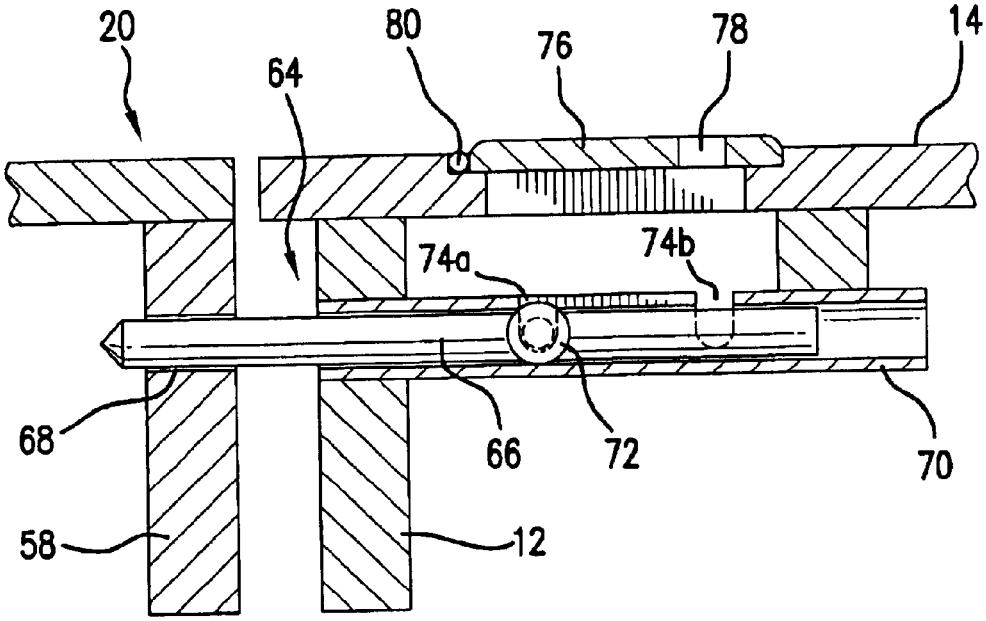
FIG. 6 shows a detailed cross-section view of the lock in a locked condition according to the invention.
Figure 7:
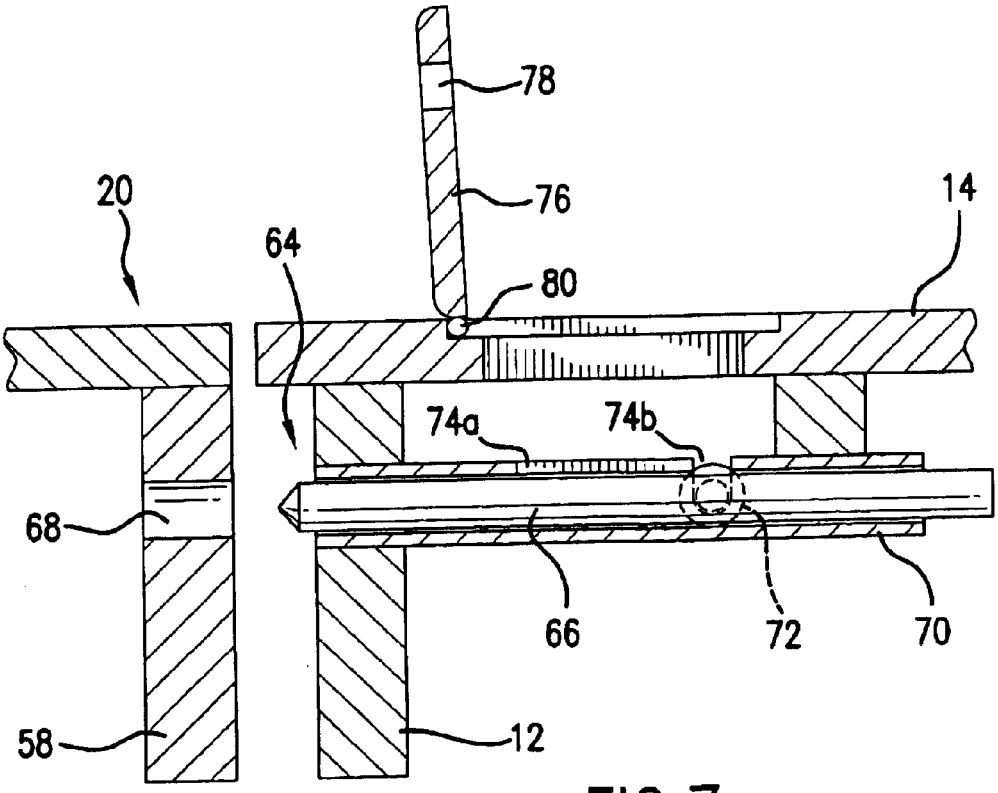
FIG. 7 shows a detailed cross-section view of the lock in an unlocked condition according to the invention.

Referring to FIGS. 6 and 7, in the preferred embodiment, a lock, designated generally as 64, is operatively associated with stationary platform 14 and movable platform 18 for locking movable platform 18 to stationary platform 14 in the raised position. The lock provides an added measure of safety to prevent the movable platform from accidentally lowering with people standing on the movable platform. Lock 64 preferably includes a first locking part 66 carried by stationary platform 14 and upper dock frame 12, and a second locking part 68 carried by landing frame 58 of movable platform 18. First locking part 66 engages second locking part 68 when movable platform 18 is in the raised position to interlock stationary platform 14 with movable platform 18. First locking part 66 preferably comprises a reinforced metal deadbolt and second locking part 68 comprises a receiving unit carried by landing frame 58 adapted to engaged the deadbolt. Deadbolt 66 is carried in sleeve 70 so that the deadbolt can be slidably engaged with receiving unit 68 to lock the platforms together. Deadbolt 66 includes a prong 72 for manually sliding the deadbolt between an extended position engaging receiving unit 68, shown in FIG. 6, and a retracted position withdrawn from receiving unit 68, shown in FIG. 7. Notches 74*a* and 74*b* are provided in sleeve 70 for securing the deadbolt in the extended or retracted positions by seating prong 72 in notch 74*a* to secure the deadbolt in the extended position, or seating prong 72 in notch 74*b* to secure the deadbolt in the retracted position.

Preferably, as shown in FIGS. 6 and 7, lock 64 is disposed beneath stationary platform 14 to prevent tripping over the lock. Hatch 76 is carried by stationary platform 14 for providing access to lock 64 through stationary platform 14. Hatch 76 includes a finger hole 78 for opening the hatch, which is pivotally attached to stationary platform 14 by hinge 80.

While a preferred embodiment of the invention has been described using specific terms, such description is for illustrative purposes only, and it is to be understood that changes and variations may be made without departing from the spirit or scope of the following claims.

What is claimed is:

1. A water recreation dock extending at least partially over a body of water adapted for providing access into and out of the water comprising:

an upper dock frame;

a main deck platform carried by said upper dock frame for accommodating a number of persons engaged in recreational activities;

a stationary platform forming a first part of said main deck platform on said upper dock frame;

a movable platform carried by said upper dock frame forming a second part of said main deck platform having a raised position and a lowered position;

a landing section and a walkway section included in said movable platform;

said movable platform located generally in a common horizontal plane with said stationary platform in said raised position so that said landing section and walkway section are positioned above the water within an opening of said stationary platform adapted to receive said landing section and walkway section so that said movable platform is bordered on at least two sides by said stationary platform to provide a uniformly level main deck platform; and, said movable platform adapted for being at least partially submerged in the water below said stationary platform in said lowered position wherein said landing section is adapted to be submerged and said walkway section extends from said stationary platform to said landing section to provide access into and out of the water.

2. The dock of claim 1 including a drive assembly carried at least in part by said stationary platform; said drive assembly operatively connected with said movable platform for raising and lowering said movable platform.

3. The dock of claim 2 wherein said drive assembly includes a vertical displacement mechanism extending downward beneath said stationary platform, and a drive motor carried by said stationary platform above the water; said vertical displacement mechanism carrying said movable platform, and said drive motor operatively connected with said vertical displacement mechanism; said drive motor and said vertical displacement mechanism cooperating to move said platform between said raised and lowered positions.

4. The dock of claim 3 wherein said vertical displacement mechanism includes an elongated shaft extending vertically beneath said stationary platform, and a lateral support arm extending perpendicular to said elongated shaft carrying said landing section; said lateral support arm traveling on said elongated shaft when said drive motor is operated to raise and lower said landing section.

5. The dock of claim 4 wherein said lateral support arm has a first portion carrying a threaded collar for cooperating with threads included in said elongated shaft to raise and lower said lateral support arm; said lateral support arm having a second portion engaging said landing section; said drive motor rotating said shaft to cause said threaded collar to travel along said threads of said elongated shaft so that said lateral support arm raises and lowers said landing section.

6. The dock of claim 4 including a guide member carried by said upper dock frame for housing said elongated shaft; said guide having an arm slot extending along the length of said guide member for allowing said lateral support arm to be moved vertically along said elongated shaft while extending through said guide; and said landing section abutting said guide to restrict lateral movement of said movable platform.

7. The dock of claim 1 wherein said walkway includes a set of collapsible steps; said collapsible steps having a collapsed condition when said movable platform is in said raised position wherein each of said steps is folded into lateral alignment in a common horizontal plane with said stationary platform, and said collapsible steps having an expanded condition when said movable platform is in said lowered position wherein each of said steps is staggered in an inclined arrangement to provide steps leading from said stationary platform to said landing section.

8. The dock of claim 7 including a step frame carrying said collapsible steps; said step frame having a first end pivotally connected to said stationary platform, and a second end pivotally connected to said landing section for moving with said landing section between said raised and lowered positions to collapse and expand said steps.

9. The dock of claim 8 wherein each of said steps carries a support leg; said support leg slidably engaging said step frame to move between a support position holding said step in said expanded condition, and a retracted position allowing said step to move to said collapsed condition.

10. A movable water access and support apparatus for use with an associated structure supported above a body of water, such as a dock, to provide access into and out of the water, said apparatus comprising:

a movable platform having a raised position and a lowered position when attached to said associated structure;

a landing section included in said movable platform adapted for being submerged in the water when attached to said associated structure;

a walkway section included in said movable platform for extending between said landing section and said associated structure when attached to said associated structure;

a drive assembly having a vertical displacement mechanism adapted for extending downward beneath said associated structure for mounting said movable platform to said associated structure; and, said vertical displacement mechanism including an elongated shaft adapted for extending vertically beneath said associated structure, a lateral support arm extending perpendicular to said elongated shaft adapted to carry said landing section, and a drive motor operatively associated with said elongated shaft; said lateral support arm traveling on said elongated shaft when said drive motor is operated to raise and lower said landing section;

whereby said drive assembly is constructed and arranged for vertically displacing said movable platform between said raised position wherein said landing section and said walkway section are generally aligned in a common horizontal plane with said associated structure above the water, and said lowered position wherein said landing section is adapted to be submerged in the water with said walkway extending between said associated structure and said landing section.

11. The apparatus of claim 10 including a guide member carried by said associated structure for housing said elongated shaft; said guide having an arm slot extending along the length of said guide member for allowing said lateral support arm to be moved vertically along said elongated shaft while extending through said guide; and said landing section abutting said guide to restrict lateral movement of said movable platform.

12. The apparatus of claim 10 wherein said walkway includes a set of collapsible steps; said collapsible steps having a collapsed condition in said raised position wherein each of said steps is folded into lateral alignment in a common horizontal plane with said upper surface of said associated structure, and said collapsible steps having an expanded condition in said lowered position wherein each of said steps is staggered in an inclined arrangement to provide steps leading from said upper surface of said associated structure to said landing section.

13. The apparatus of claim 12 including a step frame carrying said collapsible steps; said step frame having a first end pivotally connected to said upper surface of said associated structure, and a second end pivotally connected to said landing section for moving with said landing section between said raised and lowered positions to collapse and expand said steps.

14. A water recreation dock adapted for extending at least partially over a body of water to provide access into and out of the water comprising:

a main deck platform supported above said water;

a stationary platform forming a first part of said main deck platform;

a movable platform forming a second part of said main deck platform having a raised position located generally in a common horizontal plane with said stationary platform above the water, and a lowered position wherein said movable platform is adapted for being at least partially submerged in the water below said stationary platform;

a lock operatively associated with said stationary platform and said movable platform for locking said movable platform to said stationary platform in said raised position; and, said lock including a first locking part carried by said stationary platform, and a second locking part carried by said movable platform, wherein said first locking part engages said second locking part when said movable platform is in said raised position to interlock said stationary platform with said movable platform.

15. The dock of claim 14 wherein said movable platform includes a landing section and a walkway section; said landing section and walkway section located generally in a common horizontal plane with said stationary platform above the water when said movable platform is in said raised position; and said landing section submerged and said walkway partially submerged as extending from said stationary platform to said landing section when said movable platform is in said lowered position.

16. The dock of claim 15 wherein said walkway includes a set of collapsible steps; said collapsible steps having a collapsed condition when said movable platform is in said raised position wherein each of said steps is folded into lateral alignment in a common horizontal plane with said stationary platform, and said collapsible steps having an expanded condition when said movable platform is in said lowered position wherein each of said steps is staggered in an inclined arrangement to provide steps leading from said stationary platform to said landing section.

17. The dock of claim 14 including a drive assembly carried at least in part by said stationary platform; said drive assembly operatively connected with said movable platform for raising and lowering said movable platform.

18. The dock of claim 17 wherein said drive assembly includes a vertical displacement mechanism extending downward beneath said stationary platform, and a drive motor carried by said stationary platform above the water; said vertical displacement mechanism carrying said movable platform, and said drive motor operatively connected with said vertical displacement mechanism; said drive motor and said vertical displacement mechanism cooperating to move said platform between said raised and lowered positions.

* * * * *